United States Patent [19]

Gosswiller

[11] Patent Number: 4,847,590

[45] Date of Patent: Jul. 11, 1989

[54] OUTDOOR WARNING SIREN

[75] Inventor: Earl W. Gosswiller, Pompano Beach, Fla.

[73] Assignee: Federal Signal Corporation, Oak Brook, Illinois

[21] Appl. No.: 186,170

[22] Filed: Apr. 26, 1988

[51] Int. Cl.[4] ..... G08B 3/00; G10K 7/00

[52] U.S. Cl. ..... 340/405; 340/404; 340/384 R; 381/156; 181/143; 181/144; 181/175; 181/188; 116/137 R; 116/147

[58] Field of Search ..... 340/405, 404, 384 R, 340/384 E; 116/137 R, 147; 381/156, 182; 181/143, 144, 175, 187, 188, 189, 191

[56] References Cited

U.S. PATENT DOCUMENTS

| | | | |
|---|---|---|---|
| 1,149,583 | 8/1915 | Hutchison | 340/405 |
| 4,529,969 | 7/1985 | Gosswiller | 340/405 |
| 4,558,656 | 12/1985 | Powell | 340/405 |

*Primary Examiner*—Donnie L. Crosland

*Attorney, Agent, or Firm*—Leydig, Voit & Mayer

[57] ABSTRACT

An improved outdoor warning siren comprising an electromechanical siren together with a multi-segment horn which effects an exceptionally smooth transition from a small high pressure area at the horn inlet to a larger low pressure area at the horn outlet thereby producing increased sound output with reduced power requirements.

31 Claims, 5 Drawing Sheets

FIG. 3
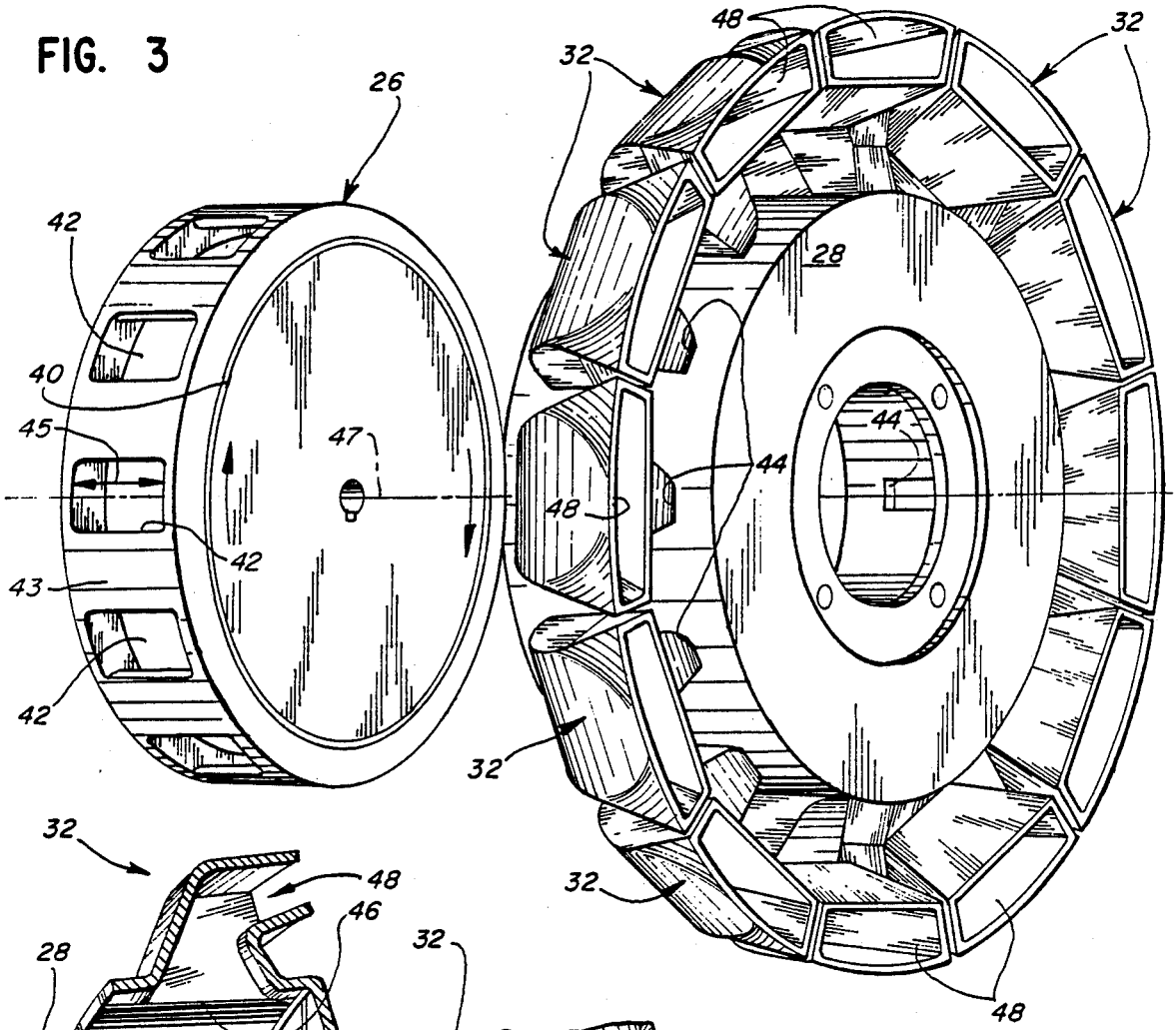
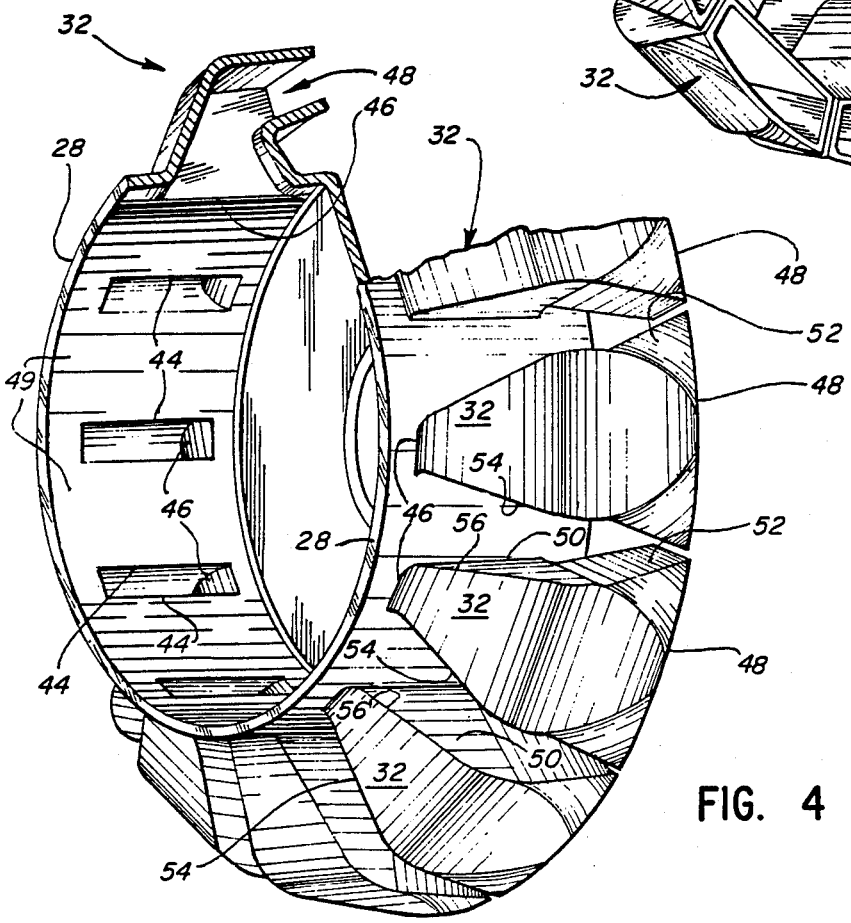
FIG. 4

OUTDOOR WARNING SIREN

BRIEF SUMMARY OF THE INVENTION

The present invention relates to an outdoor warning siren which is capable of generating a high sound output with significantly lower power requirements than conventional sirens. One extremely important advantage of the reduced power requirement is that it is feasible to power the siren with a dc motor powered by batteries which offers a significant safety feature by enabling the siren to be functional even if power lines are inoperative.

One power option is to provide a dc siren motor together with batteries and also an ac rectifier so that the dc motor can be operated on either ac or dc power with low power requirements. Heretofore, while it was possible to power a siren with a dc motor and batteries, such an arrangement was not practical because too many batteries were required to provide the desired high sound output.

It is therefore a general object of the present invention to provide an outdoor warning siren which affords high sound output coupled with reduced power requirements so it is feasible to power the siren with a dc motor and batteries.

Another more specific object of my invention is to provide an electromechanical siren comprising a chopper which produces sound impulses and a multi-stage horn which conducts the sound impulses and air flow from small high pressure areas at the outlets of the chopper to a larger low pressure area at the outlet of the horn.

Still another of my objects is to provide an electromechanical siren as last above-mentioned where the horn is designed to effect the transition from a small high pressure area to a larger low pressure area in an extremely smooth manner so as to minimize turbulence.

An additional object is to provide a siren as above-mentioned where the horn is designed to improve and facilitate the transition from outlet areas of the chopper to a second stage of the multi-stage horn so as to increase sound output while at the same time reducing power requirements.

It is a further object of my invention to provide an outdoor warning siren as described above which will direct its wound output generally horizontally throughout a 360 degree area to provide warning throughout an area surrounding the siren.

The foregoing and other objects and advantages of my invention will be apparent from the following description of certain preferred embodiments thereof, taken in conjunction with the accompanying drawings.

DESCRIPTION OF THE DRAWINGS

FIG. 3 is an enlarged exploded perspective view showing on the left a 12-port rotor and on the right a 12-port stator having twelve individual horns attached to corresponding ones of the stator outlets;

FIG. 4 is a further perspective view of the stator of FIG. 3 illustrating how each stator outlet communicates with its own individual horn which changes the direction of the sound impulses and air flow which pass out through the stator outlet;

Now, in order to acquaint those skilled in the art with the manner of making and using my invention, I shall describe, in conjunction with the accompanying drawings, certain preferred embodiments of the invention.

Detailed Description of the Invention

Figure 1:
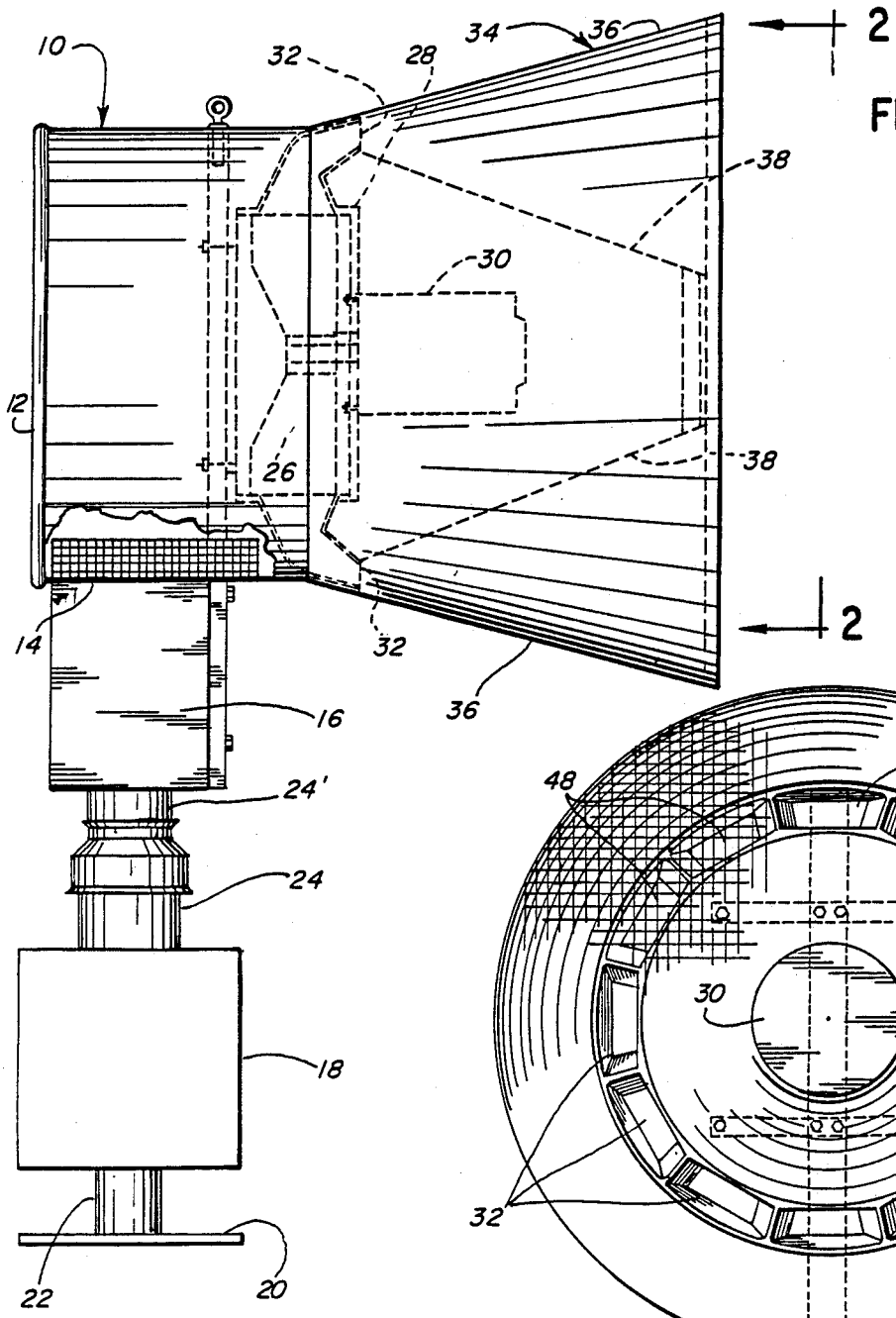
FIG. 1 is a side elevational view of an outdoor warning siren assembly constructed in accordance with one embodiment of the present invention where the outlet or mouth of the multi-segment horn is aimed generally horizontally and the entire horn is rotated about a generally vertical axis to provide warning throughout a 360 degree surrounding area.
Figure 2:
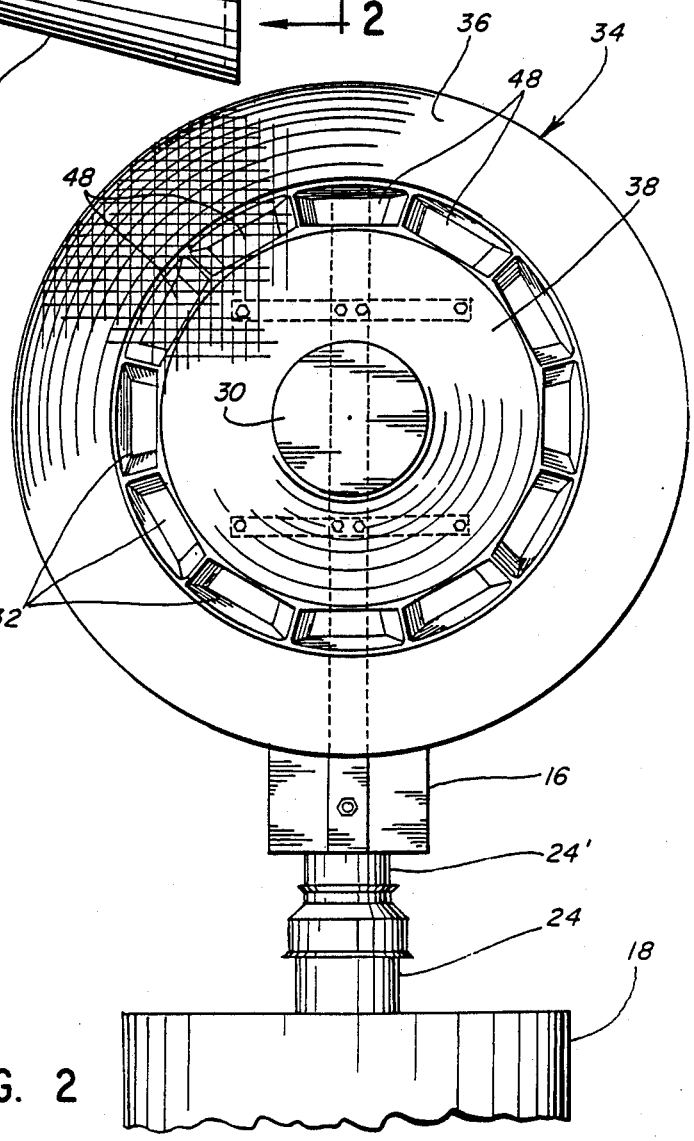
FIG. 2 is a front elevational view looking approximately in the direction of the arrows 2—2 of FIG. 1.

Referring now to the drawings, FIGS. 1 and 2 show an outdoor warning siren installation constructed in accordance with the present invention. There is shown a siren housing 10 including a removable cover 12 and a screened air intake 14. A collector ring assembly 16 is disposed beneath the siren housing, a rotator assembly is shown at 18, and a mounting plate is shown at 20. A stationary mounting post 22 extends from the mounting plate 20 upwardly through the rotator 18 and collector ring assembly 16 into the siren housing 10.

There is further provided a rotatable sleeve 24 which extends upwardly from the rotator assembly 18 and has an upper extension 24' on which the collector ring assembly 16 and siren housing 10 are supported. A conventional motor and pulley belt drive assembly (not shown) are housed within the rotator assembly 18 for rotating the sleeve 24—24' and thereby rotating the siren housing 10 and attached horn components through a 360 degree area.

A chopper assembly for producing sound impulses is supported on the housing 10 and includes a twelve-port rotor 26, a twelve-port stator 28, and a dc rotor motor 30. The chopper assembly creates sound impulses which are emitted from the twelve ports of the stator 28 as will be more fully explained later herein. There are further provided twelve exponential horns 32 which together comprise the first stage of a multi-stage horn assembly. The twelve exponential horns 32 assist in conducting the sound impulses and air flow from the stator outlets to a second stage of the horn while minimizing turbulence so as to increase sound output and reduce power requirements. More specifically, the twelve horns 32 provides an exceptionally smooth transition from twleve outlets of a stator portion of the chopper to the second stage of the horn which comprises a single horn common to the twelve horns 32.

The second stage of the multi-stage horn assembly comprises a common horn 34 including an outwardly flared outer conical element 36 and an inwardly flared inner conical element 38. It will be seen from FIG. 1 that sound impulses and air flow emitted from the outlets of the twelve exponential horns 32 enter the inlet portion of the common horn 34 and pass to the outlet thereof from which the sound is distributed generally horizontally throughout a 360 degree surrounding area as the siren and horn assembly is rotated by the rotator assembly 18.

Reference is now made to FIGS. 3–6 which illustrate the rotor 26, stator 28, and exponential horns 32 which are attached to the stator. The rotor 26 and stator 28 are essentially conventional in the art and are described in my U.S. Pat. No. 4,529,969 which is assigned to the assignee of the present invention. As shown in FIG. 3, the rotor 26 includes an annular body 40 having twelve generally rectangular ports 42 formed in the annular side wall thereof. The rotor 26 is mounted for rotation about its own axis and is driven by the motor 30 (see FIG. 1) in conventional fashion. As previously indicated, the motor 30 can be a dc motor powered on batteries or can be an ac motor or a dc and ac motor generally known as a series-universal motor. Accordingly, the outdoor warning siren may be supplied with an ac power module and a dc power module. In addition, the siren may be supplied with an ac rectifier to permit a dc motor to be operated on either ac or dc current or an ac/dc type motor which runs off either ac or dc power.

As shown in FIGS. 3 and 4, the stator 28 is shaped complementary to the rotor 26 so as to encompass the latter, and the stator 28 includes twelve rectangular ports or oules 44 formed therein. As is well known in the art, rotation of the rotor 26 within the stator 28 creates sound impulses and air flow which are emitted from each of the twelve stator outlets 44. Moreover, as previously described, each stator outlet 44 communicates with the inlet or throat of a corresponding one of the twelve exponential horns 32 which receive sound impulses and air flow directed in a somewhat radial direction from the stator and redirect such sound impulses in a direction which is generally left to right as viewed in FIG. 1.

More specifically, the sound impulses emitted from the stator outlets 44 are not emitted in precise radial directions because of the rotation of the rotor 26. Thus, referring to FIG. 5, the rotor 26 is rotated in a counterclockwise direction with the result that the sound impulses are directed generally as shown by the arrows 44' so they tend to impinge against the curved side walls 56 of the horns 32. Those curved wall portions 56 are important because they greatly facilitate the transition from small low pressure areas at the stator outlets 44 to the outlets 48 of the horns 32.

In addition, it is important to note the relative axis of the rotor outlets 42 and the outlets 48 of the horns 32. The left side of FIG. 3 shows the major axis 45 of a rectangular or oblong rotor outlet 42 and that major axis is parallel to the axis 47 of the rotor. On the other hand, the right side of FIG. 3 shows that the major axis of an oblong outlet 48 of a corresponding exponential horn 32 is rotated 90 degrees from the major axis of the rotor outlet.

Of course, the major axes of a rotor outlet 42 and a stator outlet 44 are oriented the same, but a 90 degree turn occurs in the orientation of such axis as the sound impulses pass from the stator outlet 44 to the outlet 48 to the exponential horn. Beyond that, a second turning of the sound impulses is effected in the sense that the sound impulses are emitted from the stator outlets in a wide variety of directions as shown by arrows 44' whereas such sound impulses are oriented in generally parallel directions when they are emitted from the outlets 48 of the horns 32 as shown by the right side of FIG. 3. Accordingly, as the sound impulses pass from the stator outlets 44 to the horn outlets 48, they are redirected from a variety of different directions into generally parallel directions and at the same time the major axis of each horn outlet 48 is rotated 90 degrees from the major axis of the stator outlet 44.

Figure 6:
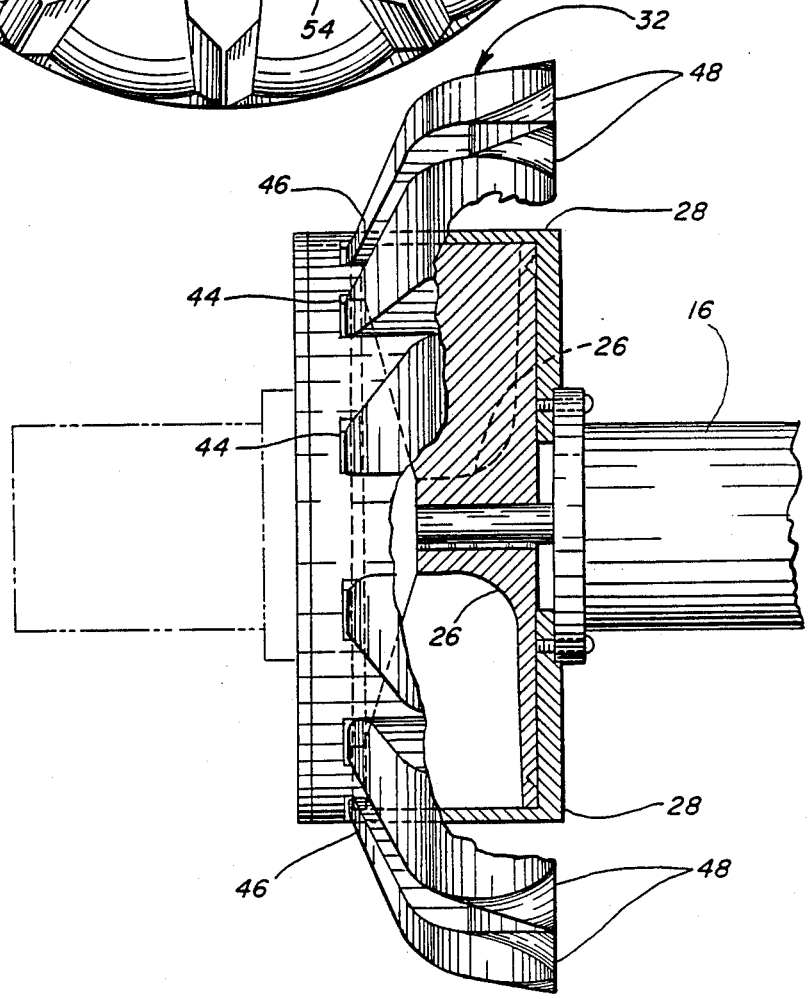
FIG. 6 is a side elevational view of the assembly of FIG. 5.

The horns 32 are designed so that the cross-sectional area thereof continually increases from the inlet or throat portion of the outlet or mouth portion thereof, the inlet being the portion shown at 46 in FIGS. 4 and 6 which communicates with the stator outlet 44, and the horn outlet being shown at 48 in FIGS. 4 and 6. In accordance with my preferred embodiment, the cross-sectional area of each horn 32 increases along its length in exponential fashion, but it is within the scope of my invention to increase the cross-sectional area by conical flaring to effect a linear increase or by catenary flaring or hyperbolic or in other ways.

It will further be seen as viewed in FIG. 6 the manner in which the sound impulses and air flow are emitted from the twelve stator ports or outlets 44 in a somewhat radial fashion but are redirected by the corresponding twelve horns 32 in parallel directions from left to right as viewed in FIG. 6. Such sound impulses emitted from the mouth or outlet 48 of each horn 32 form in effect a ring radiator or ring or sound impulses which are all directed in the same left to right direction. As a result, when the entire siren assembly mounted on housing 10 is rotated about a vertical axis as described in conjunction with FIG. 1, the siren emits a warning sound throughout the entire 360 degree surrounding area.

Figure 5:
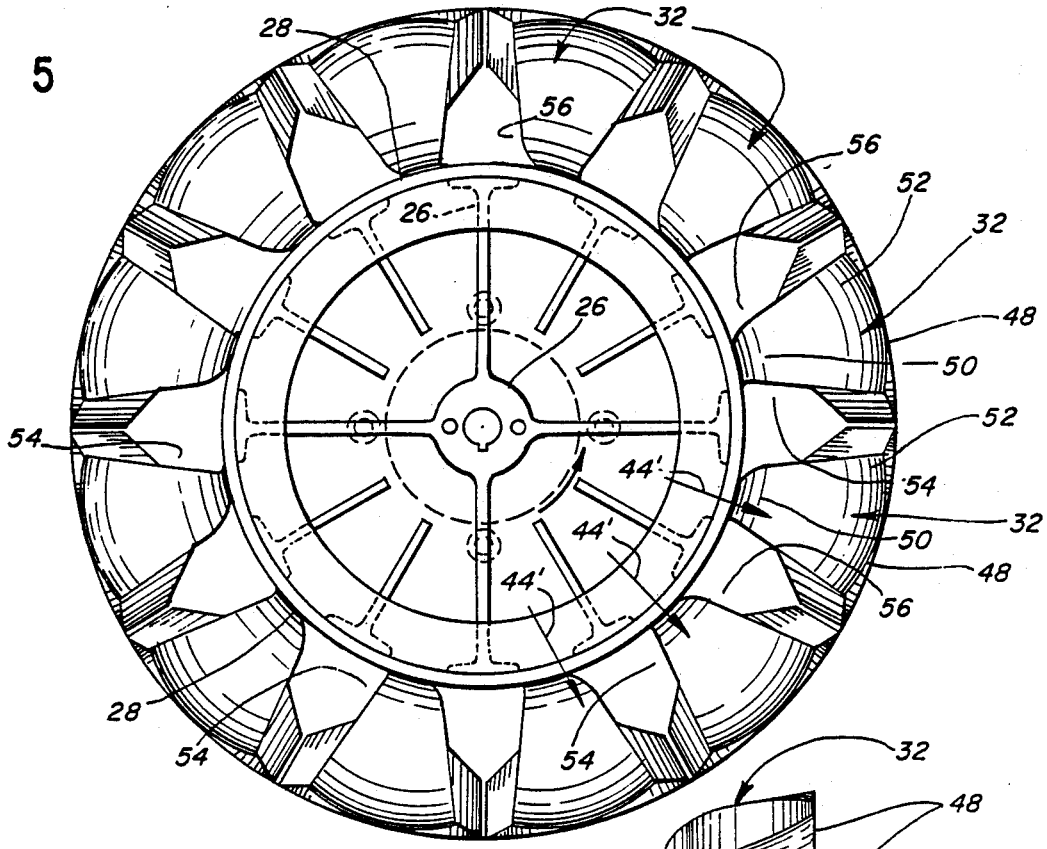
FIG. 5 is a rear elevational view of an assembly of the rotor and stator including the plurality of twelve individual horns connected to the stator outlets.

One further feature concerning the shape of each horn 32 can be seen in FIGS. 4 and 5. Referring to FIG. 4, each horn 32 begins from the inlet or throat 46 and increases in width and decreases in depth while gradually increasing in cross-sectional area, while at the same time the horn rotates 90 degrees to form a ring radiator as described above which is comprised of twelve adjacent horn outlets 48. In addition, the horn portion 50 has a straight wall 54 on one side thereof and a somewhat curved wall 56 on the opposite side thereof.

The reason for the curved horn wall 56 is to accommodate the fact that, due to rotation of the rotor 26 in a counterclockwise direction as viewed in FIG. 5, sound impulses and air flow emitted from the stator outlets 44 are not entirely in a radial direction but rather are aimed somewhat toward the horn wall 56 as shown by the arrows 44' in FIG. 5. As a result, the horn wall 56 is curved for the purpose of redirecting the sound impulses and air flow to a radial direction from the stator outlets 44, after which as previously described the sound impulses and air flow are again redirected by passing through the curved horns 32 and out the ends of mouth portions 48 so that as viewed in FIG. 1 a ring of sound impulses is emitted from the horns 34 in a left to right direction.

As previously described, the second stage of the multi-stage horn comprises the common horn shown at 34 in FIG. 1 including the outer conical member 36 and the inner conical member 38. As in the case of the individual horns 32, the common horn 34 continually increases in cross-sectional area from its inlet end to its outlet end, the inlet end being in direct commmunication with the twelve outlets of mouths 48 of the horns 32.

As shown in FIG. 1, the inner conical horn member 38 flares upwardly and the outer conical horn member 36 flares outwardly. However, the inner member 38 could be a straight cylinder, and in that event it would be preferable to flare the member 36 outwardly to a greater degree. Accordingly, the inward flaring of the inner member 38 reduces the outer dimensions of the common horn 34. As herein described, the cross-sectional area of the common horn 34 will increase linearly from the inlet to the outlet. However, it is within the scope of the invention to provide a common horn having a cross-sectional area which increases other than linearly. For example, it could increase exponentially, in hyperbolic fashion, or in catenary fashion or in some other manner.

Figure 7:
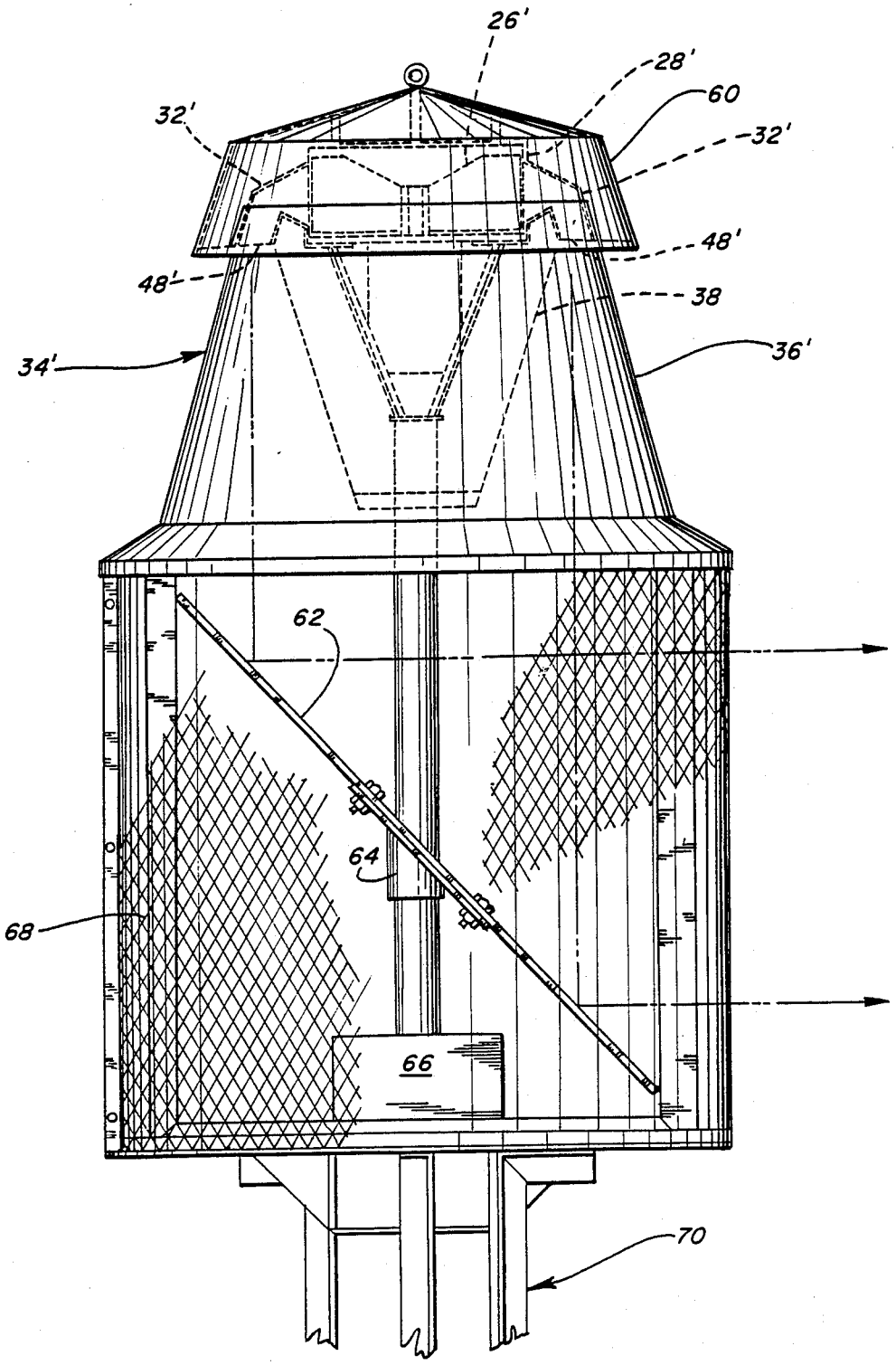
FIG. 7 is an elevational view of an alternative embodiment of the invention where the assembly of the rotor and stator and the attached multi-segment horn direct sound impulses generally downwardly and a rotatable deflector plate is utilized to direct such sound impulses generally horizontally throughout a 360 degree area.

Reference is now made to FIG. 7 which illustrates an alternative embodiment of the invention and in which components which are common to the embodiment of FIGS. 1–6 will be described by corresponding primed reference numerals. There is shown at the upper end of the assembly a screened air intake 60 beneath which is disposed a rotor 26' inside of a stator 38' which is surrounded by twelve exponential horns 32'. In the embodiment of FIG. 7, the rotor and stator are horizontally disposed so sound impulses are emitted from the stator outlets in radial or generally horizontal directions and are redirected downwardly by the twelve exponential horns 32' to create a ring of downwardly directed sound impulses which enter the upper end of the common horn 34' comprising an outwardly flared conical wall 36' and an inwardly flaring conical wall 38'.

The sound impulses which are emitted downwardly from the mouths or outlets 48' of the exponential horns 32' impinge against a rotating deflector disc 62. The disc 62 is mounted on a rotatable sleeve 64 which is rotated about a vertical axis in any desired fashion by motor means (not shown) housed within a rotator assembly 66. A screened cage 68 surrounds the rotatable deflector disc 62, and beneath the cage 68 a utility pole mounting assembly 70 is provided.

In the embodiment of FIG. 7, the upper portion of the warning siren assembly is stationary except for the rotor 26' because it is the rotatable deflector disc 62 which causes the downwardly directed sound impulse to be deflected out horizontally throughout a 360 degree area surrounding the siren assembly. The rotating deflector disc 62 is known in the art and is described in my previously mentioned U.S. Pat. No. 4,529,969.

Figure 8:
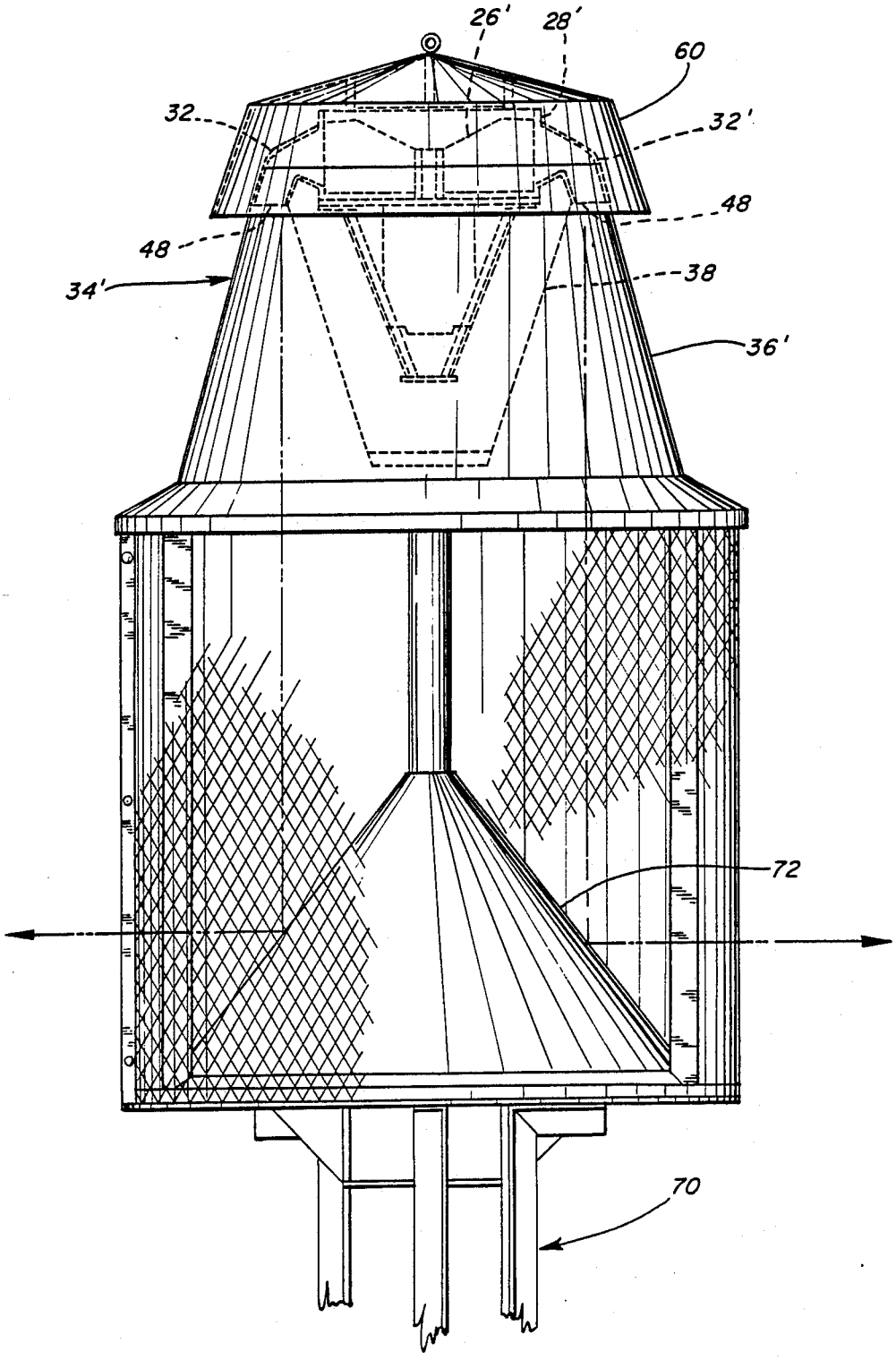
FIG. 8 is an elevational view of a further embodiment of the invention where the rotatable deflector plate of FIG. 7 is replaced by a stationary conical deflector member.

FIG. 8 shown shows still another embodiment which is the same as FIG. 7 except the rotating deflector disc 62 is replaced by a stationary conical deflector member 72. The stationary conical deflector 72 will similarly deflect the downwardly directed sound impulses around a 360 degree surrounding area, but of course the sound output will be reduced as compared to the embodiments of FIGS. 1–6 and FIG. 7 because sound is directed to the entire surrounding area continuously thus diluting the output as compared to the use of a rotating siren or a rotating deflector. The stationary deflector 72 is also known in the art and described in my U.S. Pat. No. 4,529,969.

In further explanation of the rotor 26, stator 28, and the twelve horns 32 as shown in FIGS. 3-6, it will be noted from the left hand portion of FIG. 3 that the circumferential width of the rotor openings 42 is equal to the circumferential width of the rotor closures 43, i.e., the circumferential width of the solid rotor portions 43 between the openings 42. In contrast, as shown in FIG. 4, the circumferential width of the stator openings 44 is approximately one-third of the circumferential width of the closures 49. The foregoing structure produces a theoretical sound wave pattern which is trapezoidal is shape rather than triangular as would be the case if the stator openings 44 and closures 49 were equal. It is known that a trapezoidal wave shape has a higher acoustic efficiency than a triangular wave, and thus the foregoing stator structure is advantageous.

The relatively narrow stator openings or ports 44 as shown in FIG. 4 limit the air flow through the rotor 26 and stator 28 with the result that less power is required to turn the rotor 26 which functions essentially as a centrifugal blower or compressor. I believe that the internal pressure tends to build up during the long time that the flow of air is cut off, and if so, this is important because the sound power produced is a function of the square of the pressure.

One of the objectives of my invention was to find a means for transforming the sound pressure emitted from the long axial slots 44 in the stator 28 into a ring radiator facing in an axial direction while allowing the cross-sectional area of the passageways to expand, preferably in an exponential manner. Thus, as shown in FIGS. 3 and 4, the twelve horns 32 achieve the foregoing objective, and the outlets or mouths 48 of the horns 32 form such a ring radiator and all face in the same axial direction so as to afford a highly directional characteristic.

It will also be noted from FIGS. 3 and 4 that each of the twelve horns 32 decreases in axial depth while increasing in circumferential width as it progresses from the stator outlet 44 to the horn mouth 48. Moreover, the cross-sectional area of each horn 32 increases in an exponential fashion as the horn passageway turns 90 degrees from the stator outlet 44 to the horn mouth 48.

What is claimed is:

1. An outdoor warning siren of the type including a rotor, a stator having a plurality of circumferentially spaced stator ports, and motor means for rotating the rotor within the stator to produce sound impulses which are emitted outwardly through said stator ports, the improvement comprising, in combination, a plurality of individual horns, each individual horn being connected to a corresponding one of said stator ports to receive sound impulses therefrom and having a turn to redirect the sound impulses in the same general direction, and a common horn which receives sound impulses from outlets of said individual horns and conducts the same to atmosphere to produce a warning sound to the surrounding area.

2. An outdoor warning siren as defined in claim 1 where each of said individual horns has a cross-sectional area which increases from the inlet to the outlet thereof.

3. An outdoor warning siren as defined in claim 1 where said common horn has a cross-sectional area which increases from the inlet to the outlet thereof.

4. An outdoor warning siren as defined in claim 1 where the cross-sectional area of said individual horns increases throughout the length of said horns in approximately exponential fashion.

5. An outdoor warning siren as defined in claim 1 where the cross-sectional area of said common horn increases throughout the length thereof in approximately linear fashion.

6. An outdoor warning siren as defined in claim 1 where each of said individual horns has a somewhat curved side portion against which sound impulses emitted from said stator ports impinge whereby said curved side portions facilitate transition from high pressure areas at said stator ports to low pressure areas at outlets of said individual horns.

7. An outdoor warning siren as defined in claim 1 where the inlet of each of said individual horns is somewhat oblong and has a major axis corresponding to the major axis of a corresponding stator port whereas each said individual horn has an outlet which is somewhat oblong and has a major axis which is rotated approximately 90 degrees relative to the major axis of said inlet.

8. An outdoor warning siren as defined in claim 6 where the inlet of each of said individual horns is somewhat oblong and has a major axis corresponding to the major axis of a corresponding stator port whereas each said individual horn has an outlet which is somewhat oblong and has a major axis which is rotated approximately 90 degrees relative to the major axis of said inlet.

9. An outdoor warning siren as defined in claim 1 where said motor means includes a dc motor powered by batteries.

10. An outdoor warning siren as defined in claim 5 where said common horn comprises an outer member which is flared outwardly from its inlet toward its outlet and an inner member which is flared inwardly from its inlet toward its outlet.

11. An outdoor warning siren as defined in claim 1 where said rotor, stator, individual horns and common horn are oriented so the outlet of said common horn faces generally horizontally and all of said horns are rotated about a generally vertically axis to produce a warning sound throughout the 360 degree area surrounding said siren.

12. An outdoor warning siren as defined in claim 1 where said rotor, stator, indiviual horns and common horn are oriented so the outlet of said common horn faces generally downwardly, and a rotatable, inclined reflector member disposed beneath said common horn for receiving sound impulses from said common horn and deflecting the same generally horizontally, said reflector member being rotatable about a generally vertical axis to produce a warning sound throughout the 360 degree area surrounding said siren.

13. An outdoor warning siren as defined in claim 1 where said rotor, stator, individual horns and common horn are oriented so the outlet of said common horn faces generally downwardly, and a stationary deflector positioned beneath said outlet for receiving sound impulses from said common horn and deflecting the same in all generally horizontal directions to produce a warning sound throughout the 360 degree area surrounding said siren.

14. An outdoor warning siren as defined in claim 6 where said motor means includes a dc motor powered by batteries.

15. An outdoor warning siren of the type including a rotor, a stator having a plurality of circumferentially spaced stator ports, and motor means for rotating the rotor within the stator to produce sound impulses which are emitted outwardly through said stator ports, the improvement comprising, in combination, a plurality of individual horns, each individual horn being connected to a corresponding one of said stator ports to receive sound impulses therefrom and having a turn to redirect the sound impulses in the same general direction, each individual horn having a cross-sectional area which increases throughout the length of said horn in approximately exponential fashion, and a common horn which receives sound impulses from outlets of said individual horns and conducts the same to atmosphere to produce a warning sound to the surrounding area, said common horn having a cross-sectional area which increases throughout the length thereof in approximately linear fashion.

16. An outdoor warning siren of the type including a rotor, a stator having a plurality of circumferentially spaced stator ports, and motor means for rotating the rotor within the stator to produce sound impulses which are emitted outwardly through said stator ports, the improvement comprising, in combination, a plurality of idividual horns, each one connected to a corresponding one of said stator ports and having an inlet or throat portion connected to a stator outlet port and an outlet or mouth portion directed approximately 90 degrees to said stator port whereby said individual horns redirect sound impulses emitted from said stator ports to a common direction approximately 90 degrees to said stator ports, and a common horn which receives sound impulses from outlets of all of said individual horns and conducts the same to atmosphere to produce a warning sound to the surrounding area.

17. An outdoor warning siren as defined in claim 16 where said individual horns each have a cross-sectional area which expands in an approximately exponential fashion from the inlet to the outlet thereof.

18. An outdoor warning siren as defined in claim 16 where said common horn has a cross-sectional area which increases in a linear fashion from the inlet to the outlet thereof.

19. An outdoor warning siren as defined in claim 18 where said common horn comprises an outer conical member which is flared outwardly from its inlet toward its outlet and an inner conical member which is flared inwardly from its inlet toward its outlet.

20. An outdoor warning siren as defined in claim 16 where each of said individual horns has a somewhat curved side portion against which sound impulses emitted from said stator ports impinge whereby said curved side portions facilitate transition from high pressure areas at said stator ports to low pressure areas at outlets of said individual horns.

21. An outdoor warning siren as defined in claim 20 where the inlet of each of said individual horns is somewhat oblong and has a major axis corresponding to the major axis of a corresponding stator port whereas each said individual horn has an outlet which is somewhat oblong and has a major axis which is rotated approximately 90 degrees relative to the major axis of said inlet.

22. An outdoor warning siren as defined in claim 16 where the inlet of each of said individual horns is somewhat oblong and has a major axis corresponding to the major axis of a corresponding stator port whereas each said individual horn has an outlet which is somewhat oblong and has a major axis which is rotated approximately 90 degrees relative to the major axis of said inlet.

23. An outdoor warning siren of the type including a rotor, a stator having a plurality of circumferentially spaced stator ports, and motor means for rotating the rotor within the stator to produce sound impulses which are emitted outwardly through said stator ports, said improvement comprising, in combination, said motor means including a dc motor powered by batteries, a plurality of individual horns, each one connected to a corresponding one of said stator ports and having an inlet or throat portion connected to a stator outlet port and an outlet or mouth portion directed approximately 90 degrees to said stator port whereby said individual horns redirect sound impulses emitted from said stator ports to a common direction approximately 90 degrees to said stator ports, each of said individual horns having a cross-sectional area which increases from the inlet to the outlet thereof in approximately exponential fashion, and a common horn which receives sound impulses from outlets of all of said individual horns and conducts the same to atmosphere to produce a warning sound to the surrounding area, said common horn including an outer conical member which is flared outwardly from its inlet toward its outlet and an inner conical member which is flared inwardly from its inlet toward its outlet.

24. An outdoor warning siren as defined in claim 23 where said rotor, stator, individual horns and common horn are oriented so the outlet of said common horn faces generally horizontally and said horns are rotated about a generally vertical axis to produce a warning sound throughout the 360 degree area surrounding said siren.

25. An outdoor warning siren as defined in claim 23 where said rotor, stator, individual horns and common horn are oriented so the outlet of said common horn faces generally downwardly, and an inclined reflector member disposed beneath said common horn for receiving sound impulses from said common horn and deflecting the same generally horizontally, said reflector member being rotatable about a generally vertical axis to produce a warning sound throughout the 360 degree area surrounding said siren.

26. An outdoor warning siren of the type including a rotor, a stator having a plurality of circumferentially spaced stator ports, and motor means for rotating the rotor within the stator to produce sound impulses which are emitted outwardly through said stator ports, the improvement comprising, in combination, a plurality of individual horns, each individual horn being connected to a corresponding one of said stator ports to receive sound impulses therefrom and having a turn to redirect the sound impulse in the same general direction to form a ring radiator, each of said horns decreasing in axial depth while increasing in circumferential width and increasing in cross-sectional area.

27. An outdoor warning siren as defined in claim 26 where the cross-sectional area of each said horn increases exponentially.

28. An outdoor warning siren as defined in claim 26 where the circumferential width of said stator ports is less than the circumferential width of stator closures between said ports, said stator ports being relatively long axially and relatively narrow circumferentially.

29. An outdoor warning siren as defined in claim 26 where each said horn has a generally straight wall on one side thereof and a generally curved wall on the opposite side thereto, said curved wall serving to facilitate the redirecting of said sound impulses to said ring radiator.

30. An outdoor warning siren of the type including a rotor, a stator having a plurality of circumferentially spaced stator ports, and motor means for rotating the rotor within the stator to produce sound impulses which are emitted outwardly through said stator ports, the improvement comprising, in combination, a plurality of individual horns, each individual horn being connected to a corresponding one of said stator ports to receive sound impulses therefrom and having a turn to redirect the sound impulses in the same general direction to form a ring radiator, each of said horns decreasing in axial depth while increasing in circumferential width and increasing exponentially in cross-sectional area, said rotor having ports and closures having approximately the same circumferential width and said stator ports having a circumferential width which is less than the circumferential width of stator closures to form stator ports which are relatively long axially and relatively narrow circumferentially.

31. An outdoor warning siren as defined in claim 30 where each said horn has a generally straight wall on one side thereof and a generally curved wall on the opposite side thereof, said curved wall serving to facilitate the redirecting of said sound impulses to said ring radiator, and a common horn which receives sound impulses from said ring radiator and conducts the same to atmosphere to produce a warning sound to the surrounding area.

* * * * *